US008033448B2

(12) United States Patent
Breitfeld et al.

(10) Patent No.: US 8,033,448 B2
(45) Date of Patent: Oct. 11, 2011

(54) TRAY INSERT MOVABLE BETWEEN COLLAPSED AND ERECTED POSITIONS

(76) Inventors: Bridget Suzanne Breitfeld, Morristown, NJ (US); Meina Ibrahim, East Hanover, NJ (US); Sophia Yang, East Hanover, NJ (US); Jeffrey T. Wright, Concord, NH (US)

( * ) Notice: Subject to any disclaimer, the term of this patent is extended or adjusted under 35 U.S.C. 154(b) by 278 days.

(21) Appl. No.: 12/261,877

(22) Filed: Oct. 30, 2008

(65) Prior Publication Data

US 2010/0108630 A1 May 6, 2010

(51) Int. Cl.
*B65D 25/04* (2006.01)

(52) U.S. Cl. ..... 229/120.28; 229/120.26; 229/120.29; 229/120.31; 229/120.32; 229/931

(58) Field of Classification Search ..... 229/120.24, 229/120.26, 120.28, 120.29, 120.31, 120.32, 229/120.37, 931; 220/528, 529, 531; 211/126.6, 211/130.1, 132.1

See application file for complete search history.

(56) References Cited

U.S. PATENT DOCUMENTS

| | | | | | |
|---|---|---|---|---|---|
| 1,570,963 | A | | 1/1926 | Hamilton | |
| 1,812,126 | A | | 6/1931 | Walker | |
| 1,948,326 | A | | 2/1934 | Bergquist | |
| 1,964,294 | A | | 6/1934 | MacDonald | |
| 1,999,909 | A | * | 4/1935 | Lupton | 229/120.26 |
| 2,051,512 | A | | 8/1936 | Bergquist | |
| 2,391,230 | A | * | 12/1945 | Dickerman | 229/120.26 |
| 2,527,701 | A | * | 10/1950 | Buttery | 229/931 |
| 2,738,917 | A | * | 3/1956 | Mader | 229/120.29 |
| 2,809,896 | A | * | 10/1957 | Pierson et al. | 229/120.32 |
| 2,949,218 | A | | 8/1960 | Sloan | |
| 2,985,075 | A | * | 5/1961 | Knutsson-Hall | 493/274 |
| 3,092,300 | A | * | 6/1963 | Johnson | 229/120.29 |
| 3,197,111 | A | * | 7/1965 | Kozlowski et al. | 229/120.29 |
| 3,263,894 | A | * | 8/1966 | Matson | 229/120.25 |
| 3,963,167 | A | * | 6/1976 | Newgaard, II | 229/120.37 |
| 4,108,349 | A | * | 8/1978 | Pfaffendorf | 229/120.26 |
| 4,157,157 | A | * | 6/1979 | Young | 229/120.29 |
| 4,852,796 | A | * | 8/1989 | Katzman | 229/125.28 |
| 4,955,502 | A | | 9/1990 | Sorci | |
| 5,000,376 | A | | 3/1991 | Wojdyla | |
| 5,139,842 | A | | 8/1992 | Sewell | |
| 5,335,846 | A | * | 8/1994 | Smith et al. | 229/120.32 |
| 5,375,762 | A | | 12/1994 | Jacobs | |
| 5,772,110 | A | | 6/1998 | Garretson | |
| 5,826,732 | A | * | 10/1998 | Ragsdale | 211/132.1 |
| 6,702,180 | B2 | * | 3/2004 | Hsu | 229/120.28 |

* cited by examiner

*Primary Examiner* — Gary Elkins

(74) *Attorney, Agent, or Firm* — Fitch, Even, Tabin & Flannery

(57) ABSTRACT

A collapsible insert includes a series of adjacent cells. Each cell may include a support surface capable raised to an elevated position above the bottom of the tray by a pair of legs. Each leg may have a lower portion and an upper portion. The lower portion of each leg extends below the support surface and can rest on the bottom of the tray, and functions to raise the support surface to the elevated position. The upper portion of each leg extends above the support surface and is used to divide each cell and partially constrain food product within a cell while the insert is in the erected position and disposed within a tray.

13 Claims, 7 Drawing Sheets

TRAY INSERT MOVABLE BETWEEN COLLAPSED AND ERECTED POSITIONS

FIELD

This disclosure relates to an insert for use within a tray, and in particular, to an insert movable between collapsed and erected positions in a tray.

BACKGROUND

Trays can be used for containing food products in their interiors, and can having openings closed using removable lids. When the food products fill much of the interior of the tray, after removal of the lid the food products may remain at least partially recessed within the tray, thereby hindering access. Further, it can be desirable to divide the food products within the tray.

An insert may be placed within a box or tray to divide the interior into a plurality of compartments so that goods or other items may be placed within the box or tray while avoiding intermixing of the goods or items. As disclosed in U.S. Pat. No. 1,812,126, a liner for a box or carton may be constructed from a single collapsible and foldable cardboard blank. When not in use, the liner may remain folded in a flat collapsed position. During use, the liner may be configured into a partition form and placed within the carton or box to separate the food product or other materials. In particular, the single cardboard blank may contain scores and slits that are used to configure the liner from a flat position to a constructed position containing multiple compartments. After construction, the liner containing the multiple compartments may be placed within the carton or box. As a result, the liner folds into compartments and the food product or other materials are placed at the bottom of each compartment. Placing the food product at the bottom of the compartment does not place the food product or materials in an elevated position, thereby hindering both aesthetic appearance and removal of the food products. In addition, the liner is assembled prior to placement within the container. Furthermore, once the assembled liner is placed within the container, it may not be folded into a flat position inside the container but must be removed before it can be moved into its flat position.

SUMMARY

The collapsible insert includes a series of adjacent cells. Each cell may include a support surface capable of being raised to an elevated position above the bottom of the tray by a pair of legs. Each leg may have a lower portion and an upper portion. The lower portion of each leg extends below the support surface and can rest on the bottom of the tray, and functions to raise the support surface to the elevated position. The upper portion of each leg extends above the support surface and is used to divide each cell and partially constrain food product within a cell while the insert is in the erected position. A bottom panel may optionally extend between bottom ends of the lower portion of the legs, opposite the support surface, to increase stability to the cell.

Each support surface has a generally rectangular shape and includes a pair of transverse ends and longitudinal ends extending between corner regions of the support surface. The transverse ends generally extend perpendicular to the longitudinal ends from a corner region of a leg to an adjacent corner region of the other opposite leg. The longitudinal ends generally extend perpendicular to the transverse ends, each from a corner region of a leg to the adjacent corner region of the same leg parallel to the leg.

Each support surface connects to the pair of legs to form an integral leg and an attached leg. Each leg may be generally rectangular and have a generally planar surface. The integral leg includes the support surface connecting integrally to the leg at a hinge located generally along the longitudinal end of the support surface proximate to the integral leg. The attached leg includes the support surface connecting to the leg by having an inner portion of the attached leg adhered to a flap extending from the support surface. The flap is generally rectangular having a generally planar surface and extending from a hinge located at the longitudinal end of the support surface proximate to the attached leg. The flap is configured to be generally perpendicular to the support surface such that the generally planar surface of the flap may be adhered or connected to the inside of the leg to connect the support surface with the attached leg.

The bottom surface may be located below the support surface. Portions of the attached leg and the integral leg connect the support surface to the bottom surface. The bottom surface is generally rectangular and has a pair of transverse ends and longitudinal ends extending from corner regions of the bottom surface. The transverse ends generally extend perpendicular to the longitudinal ends from a corner region of a leg to an adjacent corner region of the other opposite leg. The longitudinal ends generally extend perpendicular to the transverse ends, each from a corner region of a leg to the adjacent corner region of the same leg along the length of the leg.

In one aspect, the insert for use in elevating food products in a tray is convertible between an erected position for elevating food products in the tray and a collapsed position. The insert includes a plurality of adjacent cells. Each of the cells may have an elevated support surface for a food product and a pair of legs to elevate the support surface and for constraining the food products on the elevated support surface. One of the product support surfaces, such as an end one of the product support surfaces, may include a hinge or fold line separating the one of the product support surfaces into a first or inner portion and a second or outer portion. The inner portion of the product support surface may include a hinge or fold line with an inner one of its associated legs to permit the inner portion to be positioned generally parallel to the legs when the insert is in the collapsed position and generally perpendicular to the legs when the insert is in the erected position. The outer portion of the product support surface can be moveable to a position generally perpendicular to an outer leg when the insert is in the erected position and generally parallel to the outer leg and angled relative to the inner portion when the insert is in the collapsed position. Alternatively, both the first and second portions may be moveable between a position generally perpendicular to the adjacent leg when the insert is in the erected position and generally parallel to the adjacent leg when the insert is in the collapsed position. The remainder of the product support surfaces each can include a hinge with each of its associated legs to permit the remainder of the elevated support surfaces to be positioned generally parallel to the legs when the insert is in the collapsed position and generally perpendicular to the legs when the insert is in the erected position.

In another aspect, a method is provided for moving an insert from a collapsed position to an erected position in a tray. The insert has a plurality of adjacent cells, each with a support surface for a food product, a pair of legs associated with each support surface capable of elevating the support surface and for constraining the food products on the support surface. An end one of the support surfaces includes a fold line separating the end one of the support surfaces into an inner portion and an outer portion. The tray includes a bottom wall and an upstanding sidewall extending about the periphery of the bottom wall, where the sidewalls include a pair of spaced apart segments with a distance corresponding to a length of the cells. In order to move the insert from the collapsed position to the erected position, the outer portion of the end one of the support surfaces is moved from a first position generally perpendicular to the inner portion of the end one of the support surfaces to a second position generally parallel to the inner portion. This in turn moves each of the support surfaces to a position of greater elevation than each of the support surfaces when in the collapsed position. When erected, there is frictional engagement between at least a portion of the sidewall and at least a portion of the insert, and preferably, though not necessarily, each tray cell.

In another aspect, an insert can be formed from a unitary paperboard form with perforations arranged for folding the form into the insert. The insert includes a plurality of adjacent cells. Each of the cells includes a generally planar support surface with a first pair of opposing edges and a second pair of opposing edges. A pair of legs are associated with each support surface. One of each pair of legs having a hinge or fold connecting the leg to an adjacent leg of an adjacent cell and permitting the cells associated with the connecting legs to pivot about the hinge to a position where the first pair of opposing edges of the adjacent cells are facing one another and the second pair of opposing edges of a cell are in line with the second pair of opposing edges of an adjacent cell. Further, one of each pair of legs each has a generally planar surface that at least partially overlaps at least a portion of each associated support surface. The remaining legs of each pair of legs each include a generally planar surface generally extending in the plane defined by the support surfaces.

DETAILED DESCRIPTION

Figure 1:
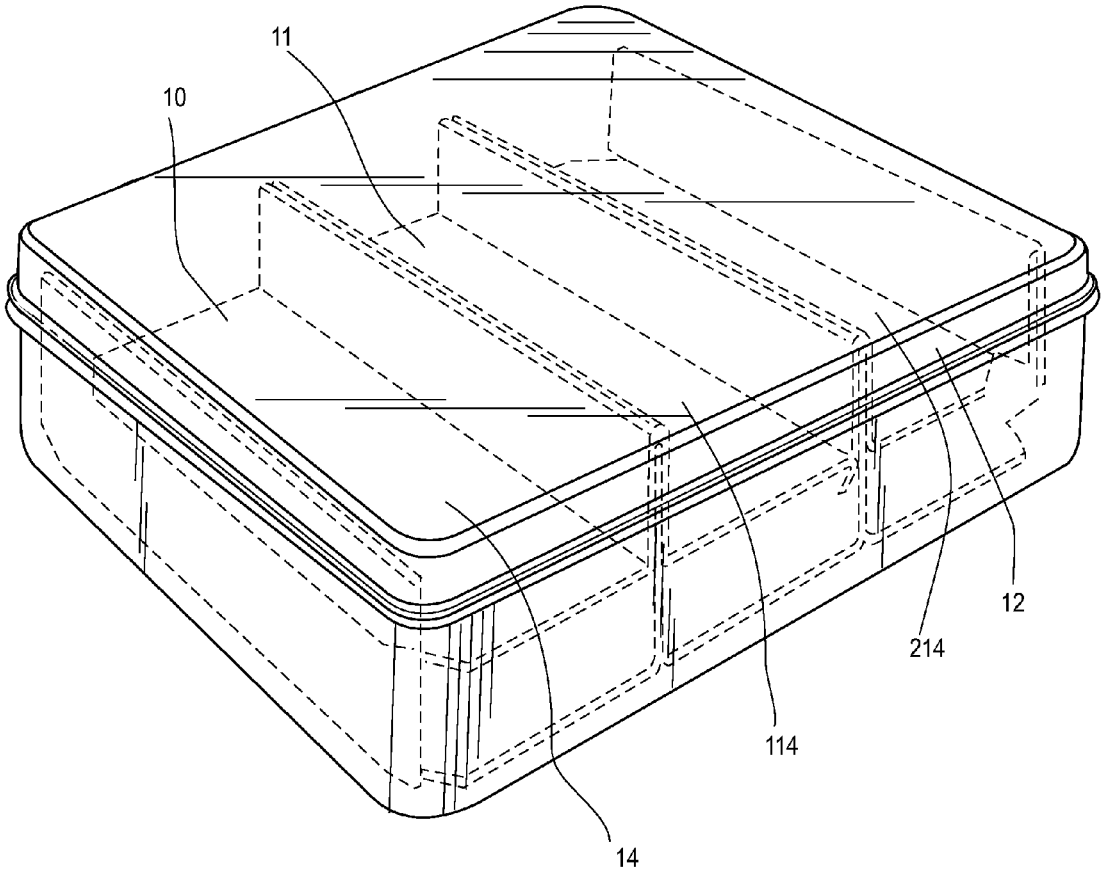
FIG. 1 is a top perspective view of a tray having an insert therein and the tray with a cover thereon.
Figure 2:
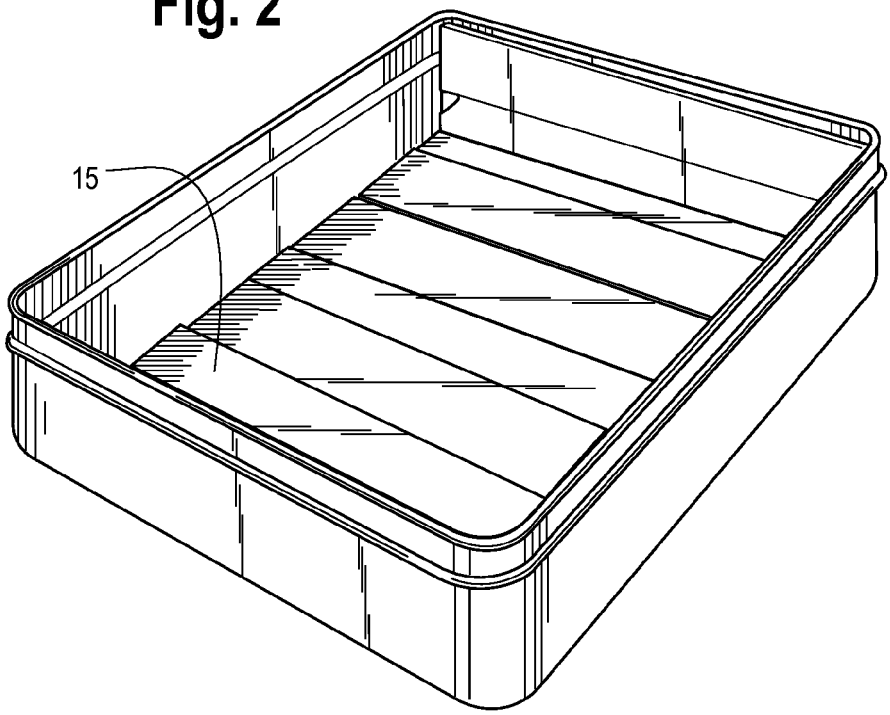
FIG. 2 is a top perspective view of a tray having an insert therein configured in a collapsed position.
Figure 3:
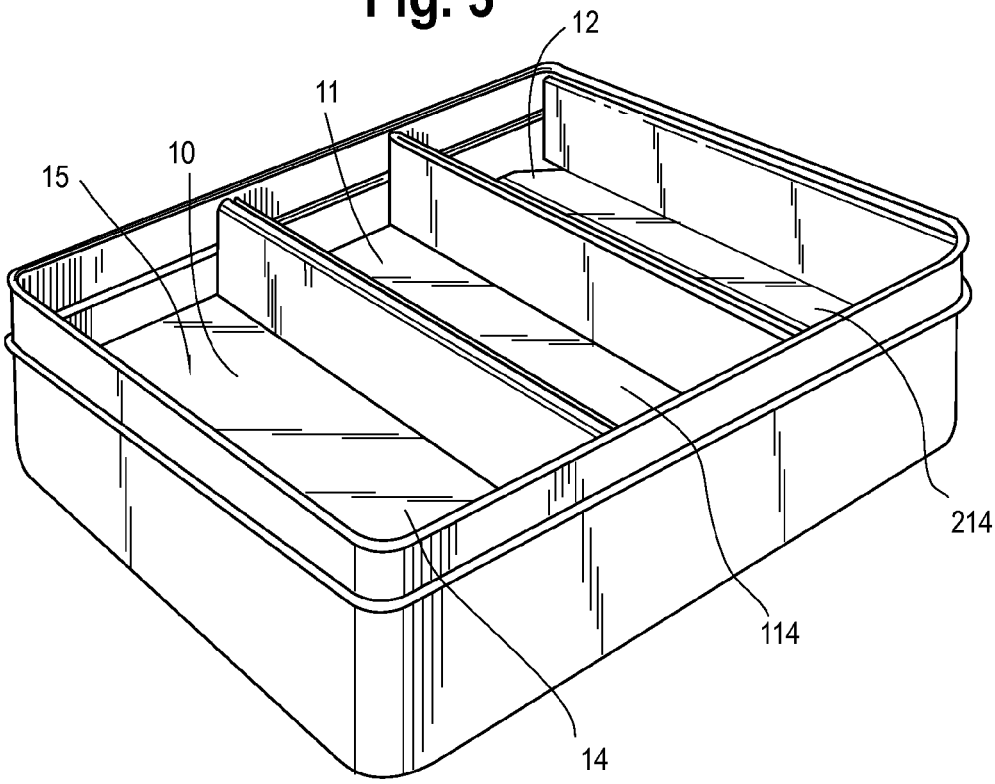
FIG. 3 is a top perspective view of the tray and insert of FIG. 2 showing the insert in an erected position.
Figure 4:
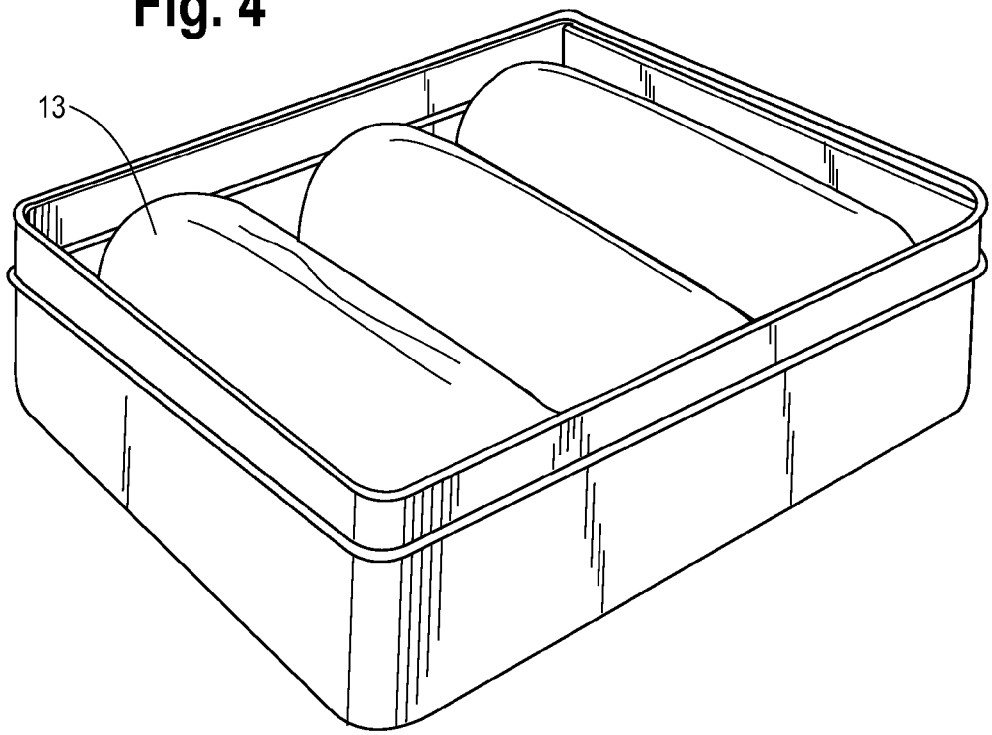
FIG. 4 is a top perspective view of the tray of FIG. 2 having the insert therein configured in the collapsed position with packaged food product disposed thereon.

An insert capable of being converted from a collapsed position to an erected position within a tray to elevate and display food product in a tray are described herein and illustrated in FIGS. 1-11. The insert may be disposed within the tray in a collapsed position with a food product resting on top of the collapsed insert, as illustrated in FIG. 2. The food product may be removed from the tray and the insert may be moved into the erected position to both segregate the food product and support the food product in an elevated position, thereby enhancing the aesthetics of the tray during serving by increasing the visibility of the food product and by improving access to the food product. The tray may be sized such that the erected insert may frictionally engage a sidewall of the tray in order to assist in maintaining the insert in the erected position and supporting the food product.

Figure 5:
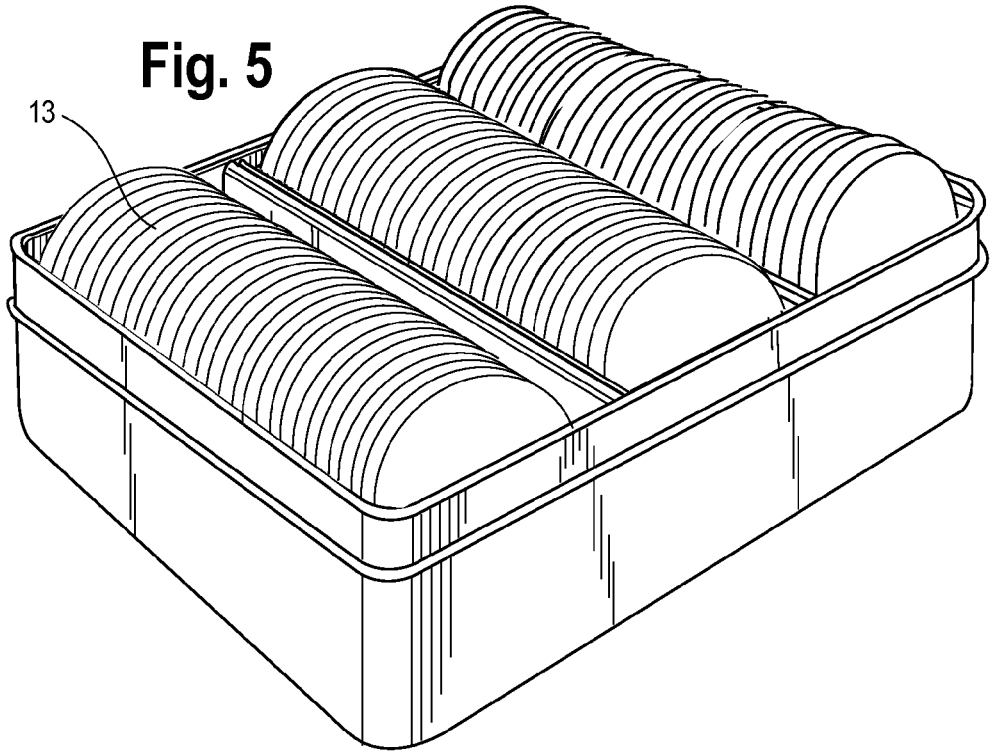
FIG. 5 is a top perspective view of the tray of FIG. 3 having the insert therein configured in the erected position and supporting the packaged food product in an elevated position within individual cells of the erected insert.
Figure 6:
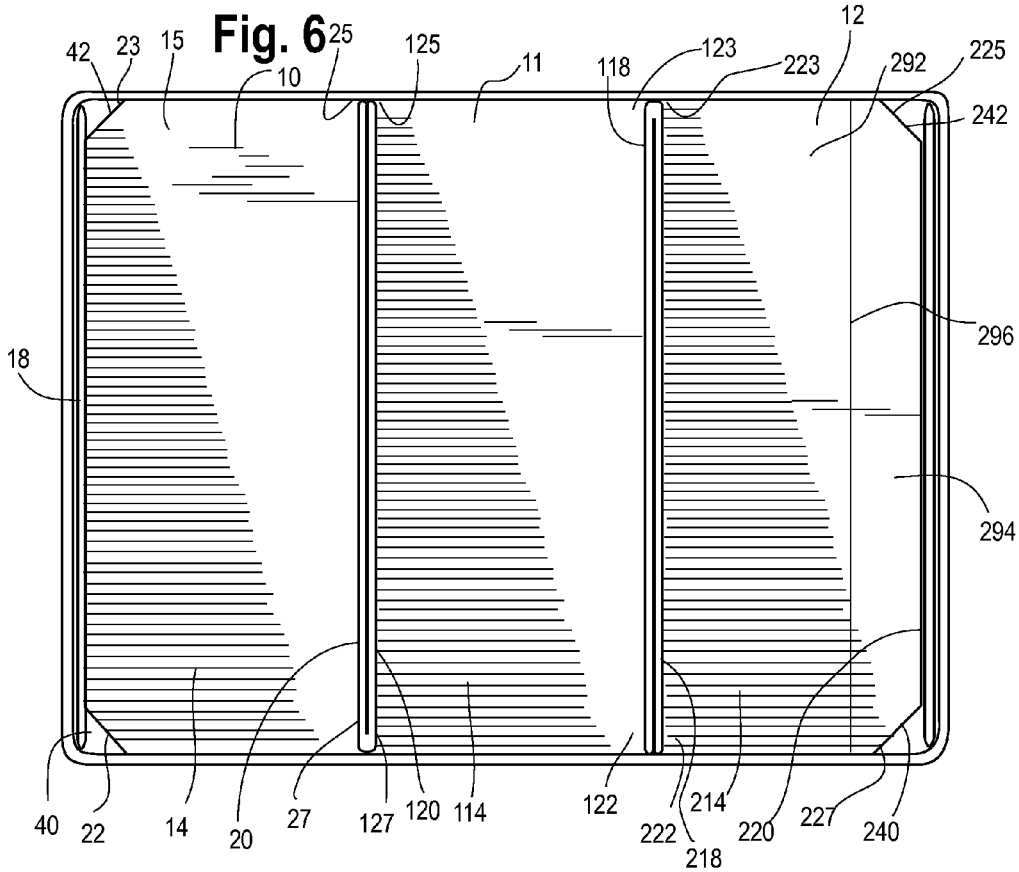
FIG. 6 is a top plan view of the erected insert and tray of FIG. 3.
Figure 7:
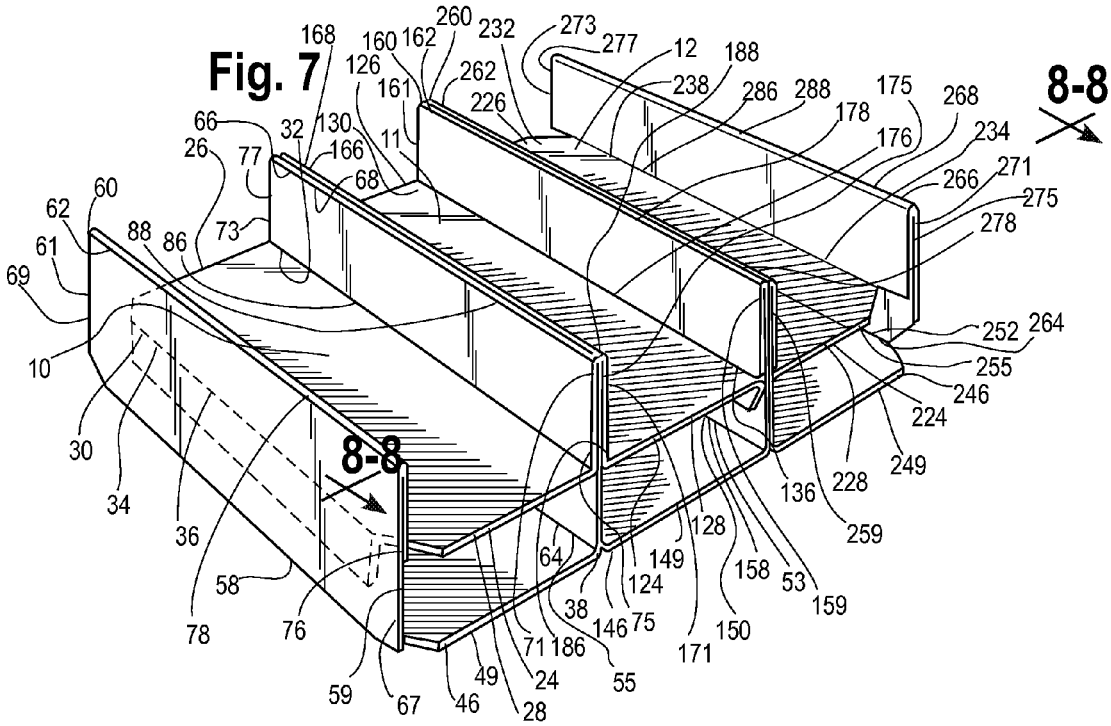
FIG. 7 is a top perspective view of the insert of FIG. 3 configured in the erected position and shown without the tray.
Figure 8:
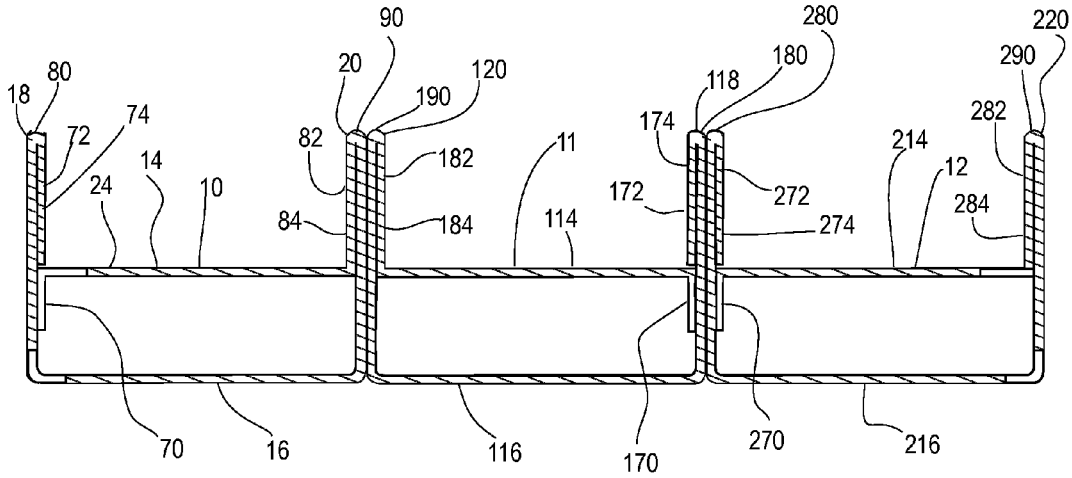
FIG. 8 is a cross-sectional view taken along line 8-8 of FIG. 7 of the insert configured in the erected position.
Figure 9:
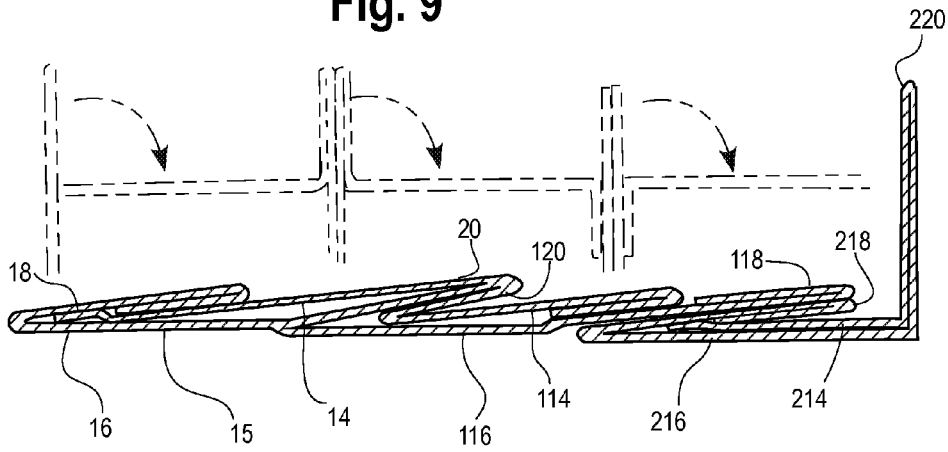
FIG. 9 is a cross-sectional view of the insert shown in FIG. 8 folding from the erected position to the collapsed position.

The insert 15 includes three cells, a first outer cell 10, a middle cell 11, and second outer cell 12. Each cell may be linked together at a pivot to form the collapsible insert 15 as illustrated in FIGS. 5-6. The first outer cell 10 is located at the end of the linked configuration and has a support surface 14 and bottom surface 16 attached to a pair of legs 18 and 20. The support surface 14 is generally rectangular having corner regions 22, 23, 25, and 27. A pair of transverse ends 24 and 26 of the support surface is located along an outer periphery 28 of the support surface 14 and extends generally perpendicular to a pair of longitudinal ends 30 and 32 of the support surface. The transverse end 24 of the support surface extends from corner region 27 disposed proximate to leg 20 to the adjacent corner region 22 disposed proximate to leg 18 and generally parallel to the opposite transverse end 26 of the support surface which extends from corner region 25 disposed at leg 20 to the adjacent corner region 23 disposed at leg 18.

The pair of longitudinal ends 30 and 32 of the support surface extends generally perpendicular to the pair of transverse ends 24 and 26 of the support surface and generally along an outer periphery 34 of the support surface 14. The longitudinal end 30 of the support surface extends generally from corner region 22 to the adjacent corner region 23 along the outer periphery 34 and proximate to leg 18 and is generally parallel to but spaced from the longitudinal end 32 of the support surface. The longitudinal end 32 of the support surface extends generally from corner region 27 to corner the adjacent corner region 25 along the outer periphery 34 and proximate to leg 20. A pair of hinges 36 and 38 is disposed on the support surface to connect the legs 18 and 20 to the support surface 14. The pair of hinges 36 and 38 is disposed at and along the longitudinal ends 30 and 32 of the support surface respectively. Hinge 36 connects support surface 14 and leg 18 such that leg 18 may pivot from a collapsed position to the erected position. Hinge 38 connects support surface 14 and leg 20 such that leg 20 may pivot from a collapsed position to the erected position.

The bottom surface 16 is disposed beneath the support surface 14 and may provide stability to the erected insert and the support surface 14 while in the erected position. The bottom surface 16 is generally rectangular and has corner regions 43, 44, 45, and 47 similar to support surface 14. A pair of transverse ends 46 and 48 located on the bottom surface 16 is located along an outer periphery 49 of the bottom surface 16 and extending perpendicular to a pair of longitudinal ends 50 and 52 located on the bottom surface. The transverse end 46 of the bottom surface extends from corner region 43 disposed proximate to leg 18 to an adjacent corner region 47 disposed proximate to leg 20 and generally parallel to the opposite transverse end 48 of the bottom surface which extends from a corner region 44 disposed proximate at leg 18 to a corner region 45 disposed proximate to leg 20.

The first outer cell 10 includes the pair of legs 18 and 20 which maintains the support surface 14 in an elevated position and constrains the food product 13 while the tray is in an elevated position. The leg 18 has a pair of longitudinal ends 58 and 60 that extend parallel to the longitudinal ends 30 of the support surface and 50 of the bottom surface respectively. The longitudinal end 58 of the leg 18 is disposed proximate to the longitudinal end 50 of the bottom surface 16 and is connected to the bottom surface 16 by hinge 53. The longitudinal end 60 of the leg 18 is located at an outer periphery 62 of the leg 18 at a distance above the support surface 14. Similarly, the leg 20 has a pair of longitudinal ends 64 and 66 that extend parallel to the longitudinal ends 32 of the support surface and 52 of the bottom surface respectively. The longitudinal end 64 of the leg 20 is disposed proximate to the longitudinal end 52 of the bottom surface and is connected to the bottom surface 16 by hinge 55. The longitudinal end 66 of the leg 20 is located at an outer periphery 68 of the leg 20 at a distance above the support surface 14.

The leg 18 has a pair of transverse ends 59 and 61 extending along a portion of the outer periphery of the leg 18 generally perpendicular to the longitudinal ends 58 and 60 of leg 18. The transverse end 59 of leg 18 is disposed on outer edge 67 of the leg 18 and extends from the corner region 43 of the bottom support surface to a location at and generally perpendicular to the longitudinal end 60 of the leg 18 at a distance above the support surface 14. The transverse end 61 of leg 18 is disposed on outer edge 69 of the leg 18 and extends from the corner region 44 of the bottom support surface to a location at and generally perpendicular to the longitudinal end 60 of the leg 18 at a distance above the support surface 14.

Similarly, the leg 20 has a pair of transverse ends 71 and 73 extending along a portion of the outer periphery of the leg 20 generally perpendicular to the longitudinal ends 64 and 66 of leg 20. The transverse end 71 of leg 20 is disposed on outer edge 75 of the leg 20 and extends from the corner region 47 of the bottom support surface to a location at and generally perpendicular to the longitudinal end 66 of the leg 20 at a distance above the support surface 14. The transverse end 73 of leg 20 is disposed on outer edge 77 of the leg 20 and extends from the corner region 45 of the bottom support surface to a location at and generally perpendicular to the longitudinal end 66 of the leg 20 at a distance above the support surface 14.

The leg 18 is attached to the support surface 14 by a flap 70. Flap 70 extends from longitudinal end 30 of the support surface 14 and is configured to be generally perpendicular to the support surface 14 while the tray is in an elevated position. Flap 70 is generally rectangular and has a generally planar surface that is connected to leg 18 via an adhesive or another form of attachment. The leg 18 has an upper portion 72 that extends above the support surface 14 and has an inner wall 74. The inner wall 74 is generally rectangular and has a pair of longitudinal ends 76 and 78 that extend generally parallel to the longitudinal ends 30 of the support surface and 50 of the bottom surface. The longitudinal end 76 of the inner wall is proximate but spaced from the longitudinal end 30 of the support surface. The longitudinal end 78 of the inner wall is located proximate and connected to longitudinal end 60 of the leg 18 by a connection 80. The inner wall 74 extends from longitudinal end 76 to longitudinal end 78 to form a generally planar surface that is adhered to an inner portion of leg 18 via an adhesive or other attachment to provide a flat configuration.

The leg 20 has an upper portion 82 that extends above the support surface 14 and has an inner wall 84. The inner wall 84 is generally rectangular and has a pair of longitudinal ends 86 and 88 that extend generally parallel to the longitudinal ends 32 of the support surface and 52 of the bottom surface. The longitudinal end 86 of the inner wall 84 is proximate and connected to the longitudinal end 32 of the support surface by hinge 38. The longitudinal end 88 of the inner wall 84 is located proximate and connected to longitudinal end 66 of leg 20 by a connection 90. The inner wall 84 extends from longitudinal end 86 to longitudinal end 88 to form a generally planar surface that is adhered to an inner portion of leg 20 via an adhesive or other attachment to provide a flat configuration.

The middle or intermediate cell 11 is located between and attached to the first outer cell 10 and the second outer cell 12 and has a support surface 114 and bottom surface 116 attached to a pair of legs 118 and 120. The support surface 114 is generally rectangular having corner regions 122, 123, 125, and 127. A pair of transverse ends 124 and 126 is located at an outer periphery 128 of the support surface 114 and extends generally perpendicular to a pair of longitudinal ends 130 and 132. The transverse end 124 extends from corner region 127 disposed proximate to leg 120 to the adjacent corner region 122 disposed proximate to leg 118 and generally parallel to the opposite transverse end 126 which extends from corner region 125 disposed at leg 120 to the adjacent corner region 123 disposed at leg 118.

The pair of longitudinal ends 130 and 132 extends generally perpendicular to the pair of transverse ends 124 and 126 and along an outer periphery 134 of the support surface 114. The longitudinal end 130 extends generally from corner region 122 to the adjacent corner region 123 along the outer periphery 134 and proximate to leg 118 and is generally parallel to the longitudinal end 132. Longitudinal end 132 extends generally from corner region 127 to the adjacent corner region 125 along the outer periphery 34 and proximate to leg 120. A pair of hinges 136 and 138 is disposed on the support surface to connect the legs 118 and 120 to the support surface 114. The pair of hinges 136 and 138 is disposed at and along the longitudinal ends 130 and 132 respectively. Hinge 136 separates support surface 114 and leg 118 and provides for leg 118 to pivot from a collapsed position to the erected position. Hinge 138 separates support surface 114 and leg 120 and provides for leg 120 to pivot from a collapsed position to the erected position.

The bottom surface 116 disposed beneath the support surface 114 and may provide stability to the erected insert and the support surface 114 while in the erected position. The bottom surface 116 is generally rectangular and has corner regions 143, 144, 145, and 147 similar to support surface 114. A pair of transverse ends 146 and 148 is located along an outer periphery 149 of the bottom surface 116 and extending perpendicular to a pair of longitudinal ends 150 and 152. The transverse end 146 extends from corner region 143 disposed proximate to leg 118 to an adjacent corner region 147 disposed proximate to leg 120 and generally parallel to the opposite transverse 148 end extending from a corner region 144 disposed proximate at leg 118 to a corner region 145 disposed proximate to leg 120.

The pair of legs 118 and 120 maintains the support surface 114 in an elevated position and constrains the food product 113 while the tray is in an elevated position. The leg 118 has a pair of transverse ends 158 and 160 that extend parallel to the longitudinal ends 130 and 150 associated with the support surface 114 and the bottom surface 116 respectively. The longitudinal end 158 is disposed proximate to the longitudinal end 150 and is connected to the bottom surface 116 by hinge 153. The longitudinal end 160 is located at an outer periphery 162 of the leg 118 at a distance above the support surface 114. Similarly, the longitudinal end 164 is disposed proximate to the longitudinal end 152 and is connected to the bottom surface 116 by hinge 155. The longitudinal end 166 is located at an outer periphery 168 of the leg 120 at a distance above the support surface 114.

The leg 118 has a pair of transverse ends 159 and 161 extending along a portion of the outer periphery of the leg 118 generally perpendicular to the transverse ends 158 and 160. The transverse end 159 is disposed on outer edge 167 of the leg 118 and extends from the corner region 144 of the bottom support surface to the longitudinal end 160 at a distance above the support surface 114. The transverse end 161 is disposed on outer edge 169 of the leg 118 and extends from the corner region 144 of the bottom support surface to the longitudinal end 160 at a distance above the support surface.

Similarly, the leg 120 has a pair of transverse ends 171 and 173 extending along a portion of the outer periphery of the leg 120 generally perpendicular to the transverse ends 158 and 160. The transverse end 171 is disposed on outer edge 175 of the leg 120 and extends from the corner region 144 of the bottom support surface to the longitudinal end 166 at a distance above the support surface 114. The transverse end 173 is disposed on outer edge 177 of the leg 120 and extends from the corner region 144 of the bottom support surface to the longitudinal end 166 at a distance above the support surface.

The leg 118 extends from the longitudinal end 150 of the bottom surface 116 to the longitudinal end 160 located a distance above the support surface 114. The leg 118 is attached to the support surface 114 by a flap 170. Flap 170 extends from longitudinal end 130 of the support surface 114 and generally perpendicular to the support surface 114 while the tray is in an elevated position. Flap 170 is generally rectangular and has a generally planar surface that is connected to leg 118 via adhesive or another form of attachment. The leg 118 has an upper portion 172 that extends above the support surface 114 and has an inner wall 174. The inner wall 174 is generally rectangular and has a pair of longitudinal ends 176 and 178 that extend generally parallel to the longitudinal ends 130 and 150. The longitudinal end 176 is proximate but spaced from the longitudinal end 130 of the support surface. The longitudinal end 178 is located proximate and connected to longitudinal end 160 by a connection 180. The inner wall 174 extends from longitudinal end 176 to longitudinal end 178 and is adhered to leg 118 via an adhesive or other attachment to provide a flat configuration.

The leg 120 extends from the longitudinal end 152 of the bottom surface 116 to the longitudinal end 166 located a distance above the support surface 114. The leg 120 has an upper portion 182 that extends above the support surface 114 and has an inner wall 184. The inner wall 184 is generally rectangular and has a pair of longitudinal ends 186 and 188 that extend generally parallel to the longitudinal ends 132 and 152. The longitudinal end 186 is proximate and connected to the longitudinal end 152 of the support surface by hinge 138. The longitudinal end 188 is located proximate and connected to longitudinal end 166 by a connection 190. The inner wall 184 extends from longitudinal end 186 to longitudinal end 188 and is adhered to leg 120 via an adhesive or other attachment to provide a flat configuration.

The second outer cell 12 is located at the end of the linked connection and has a support surface 214 and bottom surface 216 attached to a pair of legs 218 and 220. The support surface 214 is generally rectangular having corner regions 222, 223, 225, and 227. A pair of transverse ends 224 and 226 are located at an outer periphery 228 of the support surface 214 and extends generally perpendicular to a pair of longitudinal ends 230 and 232. The transverse end 24 extends from corner region 227 disposed proximate to leg 220 to the adjacent corner region 222 disposed proximate to leg 218 and generally parallel to the opposite transverse end 226 which extends from corner region 225 disposed at leg 220 to the adjacent corner region 223 disposed at leg 218.

The pair of longitudinal ends 230 and 232 extends generally perpendicular to the pair of transverse ends 224 and 226 and along an outer periphery 234 of the support surface 214. The longitudinal end 230 extends generally from corner region 222 to the adjacent corner region 223 along the outer periphery 234 and proximate to leg 218 and is generally parallel to the longitudinal end 232. Longitudinal end 232 extends generally from corner region 227 to the adjacent corner region 225 along the outer periphery 234 and proximate to leg 220. A pair of hinges 236 and 238 is disposed on the support surface to connect the legs 218 and 220 to the support surface 214. The pair of hinges 236 and 238 is disposed at and along the longitudinal ends 230 and 232 respectively. Hinge 236 separates support surface 214 and leg 218 and provides for leg 218 to pivot from a collapsed position to the erected position. Hinge 238 separates support surface 214 and leg 220 and provides for leg 220 to pivot from a collapsed position to the erected position.

The support surface 24 of the second outer cell 12 is divided into an inner portion 292 and an outer portion 294 by a weakened fold line 296. The weakened fold line 296 extends from the transverse end 246 of the support surface 214 to the transverse end 248 of the support surface 214 in a configuration that is generally parallel to and spaced from the longitudinal ends 230 and 232 of the support surface 214. The inner portion 292 extends from the weakened fold line 296 to the longitudinal end 230 of the support surface 214 and is connected to leg 218 by hinge 236. The outer portion 294 extends from the weakened fold line 296 to the longitudinal end 232 of the support surface 214 and is connected to the leg 220 by hinge 238. Instead of the weakened fold line 296 being positioned in the second outer cell 12, one or more weakened fold lines may be formed in the intermediate cell (or another cell if there are more than three cells). In that instance, the adjacent legs may fold inwardly toward each other and lie on top of the support surface in the collapsed configuration.

The bottom surface 216 is disposed beneath the support surface 214 and may provide stability to the erected insert and the support surface 214 while in the erected position. The bottom surface 216 is generally rectangular and has corner regions 244 similar to support surface 214. A pair of transverse ends 246 and 248 is located along an outer periphery 249 of the bottom surface 216 and extending perpendicular to a pair of longitudinal ends 250 and 252. The transverse end 246 extends from corner region 244 disposed proximate to leg 218 to an adjacent corner region 244 disposed proximate to leg 220 and generally parallel to the opposite transverse end 248 extending from a corner region 244 disposed proximate at leg 218 to a corner region 244 disposed proximate to leg 220.

Notches may be provided on the support surface and bottom surface to facilitate placement of the insert in the erected position into the tray. A pair of notches 40 and 42 may optionally be located at the corner regions 22 and 23 respectively.

Notches 40 and 42 allow the insert 15 to be more easily placed within the tray and to be moved from a collapsed position to the erect position while in the tray. The notch 40 is located at the corner region 22 and contacted by the transverse end 24 and the longitudinal end 30. The notch 42 is located at the corner region 23 and contacted by the transverse end 26 and the longitudinal end 32. When the insert 15 is frictionally engaged with inner surfaces of the sidewall of the tray, the notches can provide an area where there is no frictional engagement, thereby permitting the frictional engagement of the insert 15 and the tray to be more readily disengaged. Similarly, a pair of notches 54 and 56 may optionally be located on the bottom surface at the corner regions 43 and 44 associated with the leg 18. The notch 54 is located at the corner region 43 and contacted by the transverse end 46 and the longitudinal end 50. The notch 56 is located at the corner region 44 and contacted by the transverse end 48 and the longitudinal end 52. Also in a similar manner, a pair of notches 240 and 242 may optionally be located at the corner regions associated with the leg 218 and provide for the insert 15 to be more easily placed within the container and to be moved from a collapsed position to the erect position while in the container. The notch 240 is located at the corner region 222 and contacted by the transverse end 224 and the longitudinal end 230. The notch 242 is located at the corner region 223 and contacted by the transverse end 226 and the longitudinal end 232. Further, a pair of notches 254 and 256 is located on the bottom surface at the corner regions associated with the leg 220. The notch 254 is located at the corner region 247 and contacted by the transverse end 246 and the longitudinal end 252. The notch 256 is located at the corner region 245 and contacted by the transverse end 248 and the longitudinal end 252.

The pair of legs 218 and 220 maintains the support surface 214 in an elevated position and constrains the food product 213 while the tray is in an elevated position. The leg 218 has a pair of transverse ends 258 and 260 that extend parallel to the longitudinal ends 230 and 250 associated with the support surface 214 and the bottom surface 216 respectively. The longitudinal end 258 is disposed proximate to the longitudinal end 250 and is connected to the bottom surface 216 by hinge 253. The longitudinal end 260 is located at an outer periphery 262 of the leg 218 at a distance above the support surface 214. Similarly, the longitudinal end 264 is disposed proximate to the longitudinal end 252 and is connected to the bottom surface 216 by hinge 255. The longitudinal end 266 is located at an outer periphery 268 of the leg 220 at a distance above the support surface 214.

The leg 218 has a pair of transverse ends 259 and 261 extending along a portion of the outer periphery of the leg 218 generally perpendicular to the transverse ends 258 and 260. The transverse end 259 is disposed on outer edge 267 of the leg 218 and extends from the corner region 244 of the bottom support surface to the longitudinal end 260 at a distance above the support surface 214. The transverse end 261 is disposed on outer edge 269 of the leg 218 and extends from the corner region 244 of the bottom support surface to the longitudinal end 260 at a distance above the support surface.

Similarly, the leg 220 has a pair of transverse ends 271 and 273 extending along a portion of the outer periphery of the leg 220 generally perpendicular to the transverse ends 258 and 260. The transverse end 271 is disposed on outer edge 275 of the leg 220 and extends from the corner region 244 of the bottom support surface to the longitudinal end 266 at a distance above the support surface 214. The transverse end 273 is disposed on outer edge 277 of the leg 220 and extends from the corner region 244 of the bottom support surface to the longitudinal end 266 at a distance above the support surface.

The leg 218 extends from the longitudinal end 250 of the bottom surface 216 to the longitudinal end 260 located a distance above the support surface 214. The leg 218 is attached to the support surface 214 by a flap 270. Flap 270 extends from longitudinal end 230 of the support surface 214 and generally perpendicular to the support surface 214 while the tray is in an elevated position. Flap 270 is generally rectangular and has a generally planar surface that is connected to leg 218 via adhesive or another form of attachment. The leg 218 has an upper portion 272 that extends above the support surface 214 and has an inner wall 274. The inner wall 274 is generally rectangular and has a pair of longitudinal ends 276 and 278 that extend generally parallel to the longitudinal ends 230 and 250. The longitudinal end 276 is proximate but spaced from the longitudinal end 230 of the support surface. The longitudinal end 278 is located proximate and connected to longitudinal end 260 by a connection 280. The inner wall 274 extends from longitudinal end 276 to longitudinal end 278 and is adhered to leg 218 via an adhesive or other attachment to provide a flat configuration.

The leg 220 extends from the longitudinal end 252 of the bottom surface 216 to the longitudinal end 266 located a distance above the support surface 214. The leg 220 has an upper portion 282 that extends above the support surface 214 and has an inner wall 284. The inner wall 284 is generally rectangular and has a pair of longitudinal ends 286 and 288 that extend generally parallel to the longitudinal ends 232 and 252. The longitudinal end 286 is proximate and connected to the longitudinal end 252 of the support surface by hinge 238. The longitudinal end 288 is located proximate and connected to longitudinal end 266 by a connection 290. The inner wall 284 extends from longitudinal end 286 to longitudinal end 288 and is adhered to leg 220 via an adhesive or other attachment to provide a flat configuration.

The collapsible insert 15 is capable of being moved from a collapsed position to an erected position while within the container to permit an aesthetic display of the food product in the erected position. The insert 15 has a generally flat configuration while in the collapsed position such that a food product may rest generally flat on the insert 15. While in the collapsed position, many of the components of the cells, including the support surface, bottom surface, attached leg, and the integral leg of some of the cells lay flat in a generally parallel direction to one another to provide a flat configuration. By generally parallel, it is meant that they are more parallel than they are perpendicular, and includes a shingled type arrangement.

Specifically, while in the collapsed position, first outer cell 10 includes support surface 14, legs 18 and 20, and bottom surface 16. At least a portion of the support surface 14 is disposed generally parallel to and at least partially overlapping bottom surface 16. Another portion of the support surface 14 may be disposed generally parallel to and at least partially overlapping a portion of leg 20. Support surface 14 may be positioned generally flush to both the bottom surface 16 and the portion of the leg 20. The leg 18 is disposed generally parallel to the support surface 14 and the bottom surface 16. The inner wall 74 of the leg 18 partially overlaps the support surface 14 and rests generally flush against the support surface 14. The lower portion of the leg 18 at least partially overlaps the bottom surface 16 and is disposed generally flush against the bottom surface 16. Flap 70 is generally parallel to support surface 14 and sits flush against bottom surface 20. The leg 20 extends generally parallel to the support surface 14 and the bottom surface 16. The inner wall 84 of the leg 20 extends generally parallel to the support surface 14.

The intermediate cell 11 includes parts that are positioned similar to cell 12 in the collapsed position. While in the collapsed position, intermediate cell 11 includes support surface 114, legs 118 and 120, and bottom surface 116. A portion of the support surface 114 is disposed generally parallel to and at least partially overlapping bottom surface 116. Another portion of the support surface 114 may be disposed generally parallel to and at least partially overlapping a lower portion of leg 118. Support surface 114 may be positioned generally flush to both the bottom surface 116 and the lower portion of the leg 118. The leg 118 is disposed generally parallel to the support surface 114 and the bottom surface 116. The upper inner wall 174 of the leg 118 partially overlaps the support surface 114 and is disposed flush against the support surface 114. The lower portion of the leg 118 at least partially overlaps the bottom surface 116 and is disposed flush against the bottom 116. Flap 170 is generally parallel to support surface 114 and sits flush against bottom surface 116. The leg 118 extends generally parallel to the support surface 114 and the bottom surface 116. The inner wall 184 of the leg 120 extends generally parallel to the support surface 114.

Second outer cell 12 includes legs 218 and 220, a support surface 214 that includes the weakened fold line 296 that divides the support surface into the inner portion 292 and outer portion 294, and a bottom surface 216. While in the collapsed position, the inner portion 292 of the support surface extends generally parallel to the bottom surface 216 and sits flush against the bottom surface 216. The outer portion 294 of the support surface extends perpendicular to the inner portion 292 of the support surface. The leg 218 is disposed generally parallel to the inner portion 292 of the support surface and the bottom surface 216. The upper inner wall 274 of the leg 218 partially overlaps the inner portion 292 of the support surface and sits flush against the inner portion 292. The lower portion of the leg 218 partially overlaps the bottom surface 216 and sits flush against the bottom surface 216. Flap 270 is generally parallel to inner portion 292 of the support surface 214 and sits flush against bottom surface 216. The integral leg 220 extends generally perpendicular to the bottom surface 216 and the inner portion 292 of the support surface and generally parallel to the outer portion 294 of the support surface. The lower portion of the integral leg 220 at least partially overlaps the outer portion 294 of the support surface and rests flush against the outer portion 294.

The insert 15 may be moved from the collapsed position to the erected position by moving at least one cell about its associated hinges or fold lines. The cells are connected to allow for the entire insert 15 to be raised to an erected position in response to an upward movement of a leg that is connected to a pivot. Cell 10, cell 11, and cell 12 are therefore all simultaneously moved to an erected position with in the tray. As a cell is being moved to an erected position the hinges located at the longitudinal ends of the support surface and the longitudinal ends of the bottom surface allow the legs to rotate to a position that is generally perpendicular to the support surface and bottom surface and causing the support surface to be raised to an elevated position.

The legs 18 and 20 of the first outer cell 10 are moved to a position that is perpendicular to the support surface 14 and the bottom surface 16. The integral leg 20 pivots in a radial direction at hinge 55 located along the longitudinal end 52 of the bottom surface 16. The upper inner wall 84 of the integral leg 20 pivots in a radial direction at hinge 38 located along the longitudinal end 32 of the support surface 14. In response the support surface 14 is moved from a collapsed position that is flush with the bottom surface 16 to an erect position raised above the bottom surface 16. The attached leg 18 moves in the same radial direction at hinge 53 located at the longitudinal end 50 of the bottom surface 16 and hinge 36 located at the longitudinal end 30 of the support surface 14 to place the first outer cell 10 in the erected position.

Attached leg 118 and integral leg 111 of the intermediate cell 11 are moved from the collapsed position to an erect position that is perpendicular to the support surface 114 and the bottom surface 116. The attached leg 118 moves in a radial direction at hinge 153 located at the longitudinal end 150 of the bottom surface 116 and hinge 138 located at the longitudinal end 132 of the support surface 114. In response the support surface 114 is moved from a collapsed position that is flush with the bottom surface 116 to an erect position raised above the bottom surface 116. The integral leg 120 pivots in the same radial direction at hinge 155 located along the longitudinal end 152 of the bottom surface 116. The upper inner wall 184 of the integral leg 120 pivots in a radial direction at hinge 138 located along the longitudinal end 132 of the support surface 114 to place the intermediate cell 11 in the erected position.

The attached leg 218 of the second outer cell 12 is used to move the support surface 214 into an erected position. The attached leg 218 moves in a radial direction at hinge 253 located along the longitudinal end 258 of the bottom surface 216 and hinge 236 located along the longitudinal end 230 of the support surface 214. The inner portion 292 of the support surface moves from its collapsed position sitting flush against the bottom surface 216 to a raised position. In response to the movement of the inner portion 292 of the support surface, the outer portion 294 of the support surface moves in an upward radial direction. The inner portion 292 causes the weakened fold line 296 to move from its position proximate the longitudinal end 258 of the bottom support surface 216 to a raised position parallel to and in the same general plane with the inner portion 292. In response to this movement, the outer portion 294 of the support surface pivots about hinge 238 located along the longitudinal end 232 of the support surface 214. This movement causes the inner portion 292 and the outer portion 294 to extend and align with one another in the same plane to form a flat and continuous support surface 214 that is in an erected position.

Figure 10:
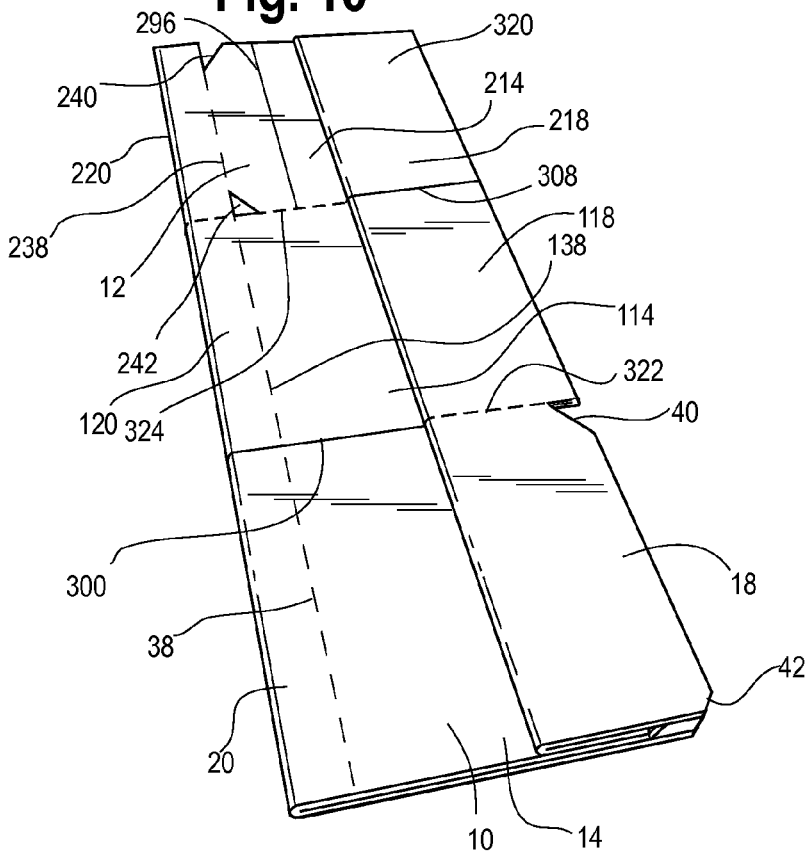
FIG. 10 is a top perspective view of a unitary paperboard blank in a folded configuration that is capable of being arranged to form the insert of FIG. 7 for placement within the tray.

The collapsible insert 15 may be made from a single paperboard or plastic material 320. The material 320 contains folds and perforations that permit folding of the material 320 to the erected position. The material 320, as shown in FIG. 10, has cells that include a pair of legs, a support surface, and a bottom surface positioned in a flat configuration. The attached leg of each cell may be moved in a radial direction causing the support surface and the integral leg of each cell to be moved to an upright position as displayed in FIG. 11. The material 320 may be moved from the upright position to form the insert in the erected position by rotating the cells along pivots as shown in FIG. 12.

The first outer cell 10 is an end cell that is connected to the intermediate cell 11 by pivot 300 and spaced from cell 12 by broken perforations 322. Cell 10 has a support surface 14 that rests flush with bottom surface 16 and a lower portion of the integral leg 20. Integral leg 20 remains parallel to the support surface 14 and extends generally in the same plane as the bottom surface 16. Attached leg 18 is parallel to the support surface 14 and rests flush with a portion support surface 14 and a portion of the bottom surface 16. The first outer cell 10 is configured in a collapsed flat position and may be raised to an upright configuration by moving the attached leg 18 in a radial direction. The attached leg 18 moves and will pivot about hinge 53 located along longitudinal end 50 of the bottom support surface 16 and the hinge 36 located along the longitudinal end 30 of the support surface. As a response, the support surface 16 will move to an upright position raised above the bottom surface 16 and cause the integral leg 20 to rotate at hinge 55 located along the longitudinal end 52 of the bottom surface and hinge 38 located along the longitudinal end 32 of the support surface 16.

Similarly, the intermediate cell 11 is connected to the adjacent first outer cell 10 by pivot 300 and to adjacent cell 12 by pivot 308. The intermediate cell 11 is spaced from the first outer cell 10 by broken perforations 322 and is spaced from the second outer cell 12 by broken perforations 324. The intermediate cell 11 has a support surface 114 that rests flush with bottom surface 116 and a lower portion of the integral leg 120. Integral leg 120 remains parallel to the support surface 114 and extends generally in the same plane as the bottom surface 116. Attached leg 118 is parallel to the support surface 114 and rests generally flush with a portion support surface 114 and a portion of the bottom surface 116. The intermediate cell 11 is configured in a collapsed flat position and may be raised to an upright configuration by moving the attached leg 118 in a radial direction. The attached leg 118 moves and will pivot about hinge 153 located along longitudinal end 150 of the bottom support surface 116 and the hinge 136 located along the longitudinal end 130 of the support surface. In response, the support surface 116 will move to an upright position raised above the bottom surface 116 and cause the integral leg 120 to rotate at hinge 155 located along the longitudinal end 152 of the bottom surface and hinge 138 located along the longitudinal end 132 of the support surface 116.

Similarly, the second outer cell 12 is connected to the adjacent intermediate cell 11 by pivot 308. The second outer cell 12 is spaced from the intermediate cell 11 by broken perforations 324. The second outer cell 12 has a support surface 214 that rests flush with bottom surface 216 and a lower portion of the integral leg 220. Integral leg 220 remains parallel to the support surface 214 and extends generally in the same plane as the bottom surface 216. Attached leg 218 is parallel to the support surface 214 and rests flush with a portion support surface 214 and a portion of the bottom surface 216. The second outer cell 12 is configured in a collapsed flat position and may be raised to an upright configuration by moving the attached leg 218 in a radial direction. The attached leg 218 moves and will pivot about hinge 253 located along longitudinal end 250 of the bottom support surface 216 and the hinge 236 located along the longitudinal end 230 of the support surface. The support surface 216 can move to an upright position raised above the bottom surface 216 and cause the integral leg 220 to rotate at hinge 255 located along the longitudinal end 252 of the bottom surface and hinge 238 located along the longitudinal end 232 of the support surface 216.

Figure 11:
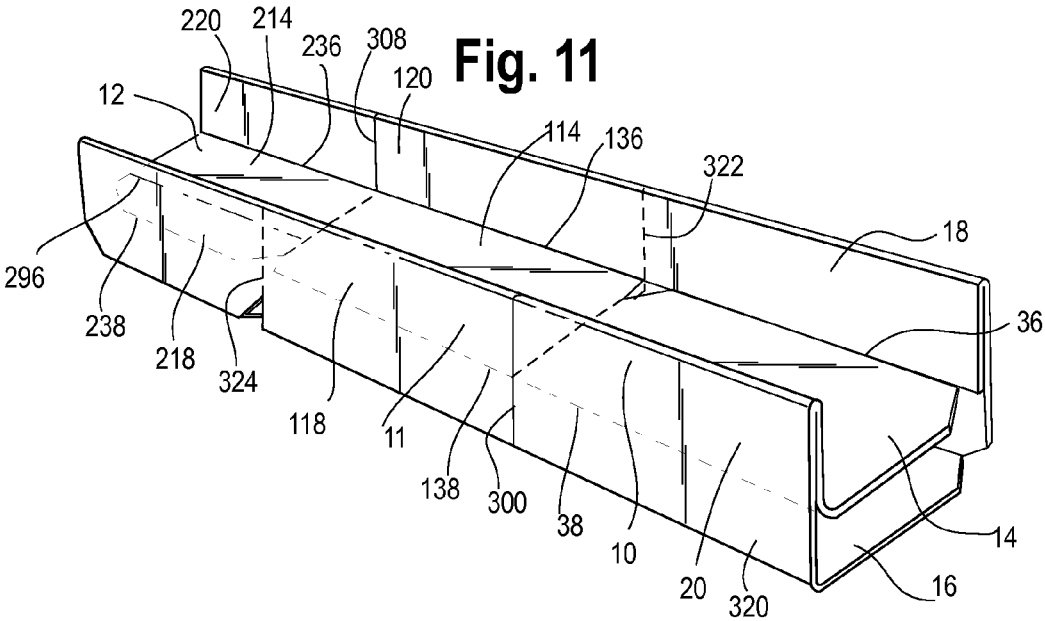
FIG. 11 is a top perspective view of a partially-configured insert made from the unitary paperboard form of FIG. 10 having an upright configuration with outer walls disposed parallel to a longitudinal axis and capable of being constructed to form the insert of FIG. 6.
Figure 12:
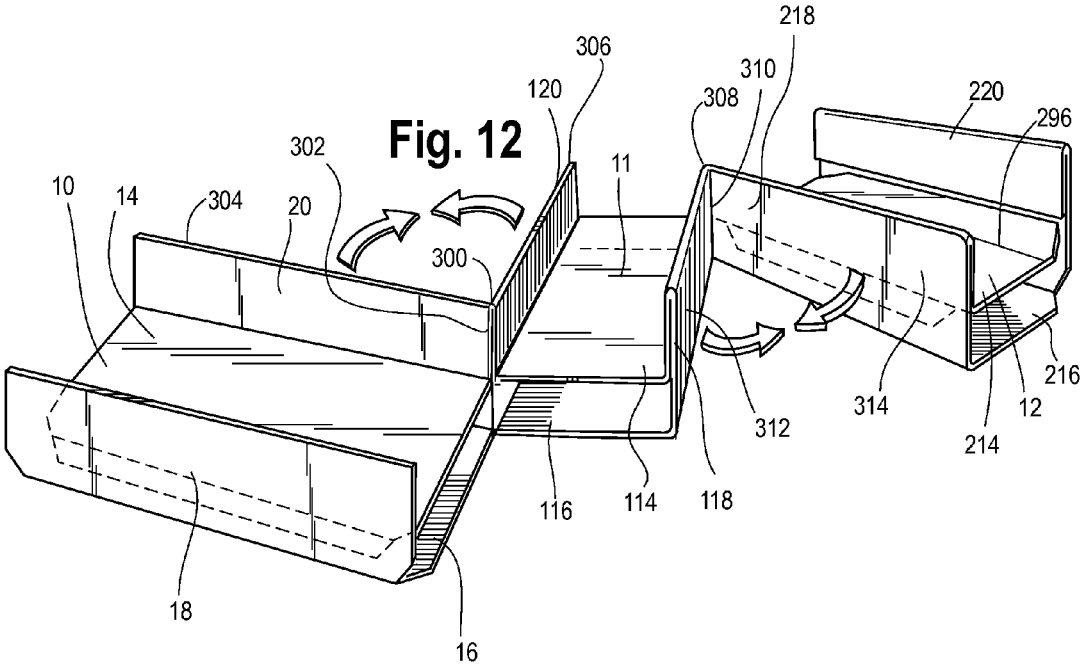
FIG. 12 is a top perspective view of the insert showing the process for moving the partially-configured insert of FIG. 10 to the erected tray insert of FIG. 7.

Each of the cells 10, 11 and 12 is attached to at least one adjacent cell by a pivot allowing a cell to move about the pivot between a general upright position as illustrated in FIG. 11 to an erected position as illustrated in FIG. 12. The first outer cell 10 is connected to the intermediate cell 11 by pivot 300. Specifically, pivot 300 forms intersection 302 between legs 20 of the first outer cell 10 and legs 120 of the intermediate cell 11 and extends generally along the transverse end 73 of leg 20 and the transverse end 173 of leg 120. While the insert 15 is in the upright position, the pivot 300 is configured to position a generally planar outer surface 304 of leg 20 parallel and generally flush with a generally planar outer surface 306 of leg 120. The intermediate cell 11 is connected to the second outer cell 12 by pivot 308. Similar to above, pivot 308 forms an intersection 310 between legs 118 of the intermediate cell 11 and legs 218 of the second outer cell 12 and extends generally along the transverse end 161 of leg 118 and the transverse end 261 of leg 218. While the insert 15 is in the upright position, the pivot 308 is configured to position a generally planar outer surface 312 of leg 118 parallel and generally flush with a generally planar outer surface 314 of leg 218. This movement will place the cells 10, 11 and 12 in position to form an insert that is in the erected configuration. Throughout the application, the terms generally parallel and generally perpendicular mean that they are more parallel than not parallel and more perpendicular than not perpendicular, respectively.

The drawings and the foregoing descriptions are not intended to represent the only forms of collapsible insert in regard to the details of construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation. For example, although the legs are illustrated as being the same height and shape, they may be of different heights and/or shapes.

What is claimed is:

1. An insert for use in elevating food products in a tray, the insert convertible between an erected position for elevating food products in the tray and a collapsed position, the insert comprising:

a plurality of adjacent cells each having an elevated product support surface for a food product and a pair of legs associated with each elevated product support surface for elevating the product support surface and constraining the food product on the elevated product support surface;

one of the product support surfaces having a fold line separating the one product support surface into an inner portion and an outer portion, the inner portion of the one product support surface having a hinge with an inner leg of the pair of legs associated with the one product support surface to permit the inner portion to be positioned generally parallel to the pair of legs associated with the one product support surface when the insert is in the collapsed position and generally perpendicular to the pair of legs associated with the one product support surface when the insert is in the erected position, and the outer portion of the one product support surface being moveable between a position generally perpendicular to an outer leg of the pair of legs associated with the one product support surface when the insert is in the erected position and a position generally parallel to the outer leg and angled relative to the inner portion when the insert is in the collapsed position;

the remainder of the product support surfaces each having a hinge with each of the associated legs to permit the remainder of the elevated support surfaces to be positioned generally parallel to the associated legs when the insert is in the collapsed position and generally perpendicular to the associated legs when the insert is in the erected position;

wherein the outer portion of the one product support surface is generally perpendicular to the inner portion of the one product support surface when the insert is in the collapsed position.

2. The insert of claim 1 wherein each leg has a pair of longitudinal ends and transverse ends and each cell has at least one of the associated legs connected to a leg of an adjacent cell by a hinge between adjacent transverse ends.

3. The insert of claim 1 wherein each cell includes a bottom support surface extending between lower end portions of the legs associated with the cell.

4. An insert for use in elevating food products in a tray, the insert convertible between an erected position for elevating food products in the tray and a collapsed position, the insert comprising:

a plurality of adjacent cells each having an elevated product support surface for a food product and a pair of legs associated with each elevated product support surface for elevating the product support surface and constraining the food product on the elevated product support surface;

one of the product support surfaces having a fold line separating the one product support surface into an inner portion and an outer portion, the inner portion of the one product support surface having a hinge with an inner leg of the pair of legs associated with the one product support surface to permit the inner portion to be positioned generally parallel to the pair of legs associated with the one product support surface when the insert is in the collapsed position and generally perpendicular to the pair of legs associated with the one product support surface when the insert is in the erected position, and the outer portion of the one product support surface being moveable between a position generally perpendicular to an outer leg of the pair of legs associated with the one product support surface when the insert is in the erected position and a position generally parallel to the outer leg and angled relative to the inner portion when the insert is in the collapsed position;

the remainder of the product support surfaces each having a hinge with each of the associated legs to permit the remainder of the elevated support surfaces to be positioned generally parallel to the associated legs when the insert is in the collapsed position and generally perpendicular to the associated legs when the insert is in the erected position;

wherein each leg has a pair of longitudinal ends and transverse ends and each cell has at least one of the associated legs connected to a leg of an adjacent cell by a hinge between adjacent transverse ends;

wherein each leg connected by the hinge has a generally planar surface that is configured to abut the generally planar surface of the connected leg.

5. An insert for use in elevating food products in a tray, the insert convertible between an erected position for elevating food products in the tray and a collapsed position, the insert comprising:

a plurality of adjacent cells each having an elevated product support surface for a food product and a pair of legs associated with each elevated product support surface for elevating the product support surface and constraining the food product on the elevated product support surface;

one of the product support surfaces having a fold line separating the one product support surface into an inner portion and an outer portion, the inner portion of the one product support surface having a hinge with an inner leg of the pair of legs associated with the one product support surface to permit the inner portion to be positioned generally parallel to the pair of legs associated with the one product support surface when the insert is in the collapsed position and generally perpendicular to the pair of legs associated with the one product support surface when the insert is in the erected position, and the outer portion of the one product support surface being moveable between a position generally perpendicular to an outer leg of the pair of legs associated with the one product support surface when the insert is in the erected position and a position generally parallel to the outer leg and angled relative to the inner portion when the insert is in the collapsed position; and the remainder of the product support surfaces each having a hinge with each of the associated legs to permit the remainder of the elevated support surfaces to be positioned generally parallel to the associated legs when the insert is in the collapsed position and generally perpendicular to the associated legs when the insert is in the erected position;

provided in combination with a generally rectangular tray having a bottom wall and an upstanding sidewall extending about the periphery of the bottom wall wherein the insert is received in an interior of the tray.

6. The insert of claim 5 wherein at least one of the product support surfaces includes a notch to facilitate placement of the insert in the erected position into the tray.

7. The insert of claim 5 wherein each elevated support surface has a pair of transverse ends that frictionally engage inner surfaces of the sidewall of the tray.

8. A method for moving an insert from a collapsed position to an erected position in a tray, the insert having a plurality of adjacent cells each having a support surface for a food product, a pair of legs associated with each support surface capable of elevating the support surface and for constraining the food product on the support surface, one of the support surfaces having a fold line separating the one support surface into an inner portion and an outer portion, a tray having a bottom wall and an upstanding sidewall extending about the periphery of the bottom wall, the sidewall having a pair of spaced apart segments with a distance corresponding to a length of the cells, the method comprising:

moving the outer portion of the one support surface from a first position generally perpendicular to the inner portion of the one support surface to a second position generally aligned with the inner portion to move each of the support surfaces to a position of greater elevation than each of the support surfaces when in the collapsed position; and frictionally engaging at least a portion of the sidewall with at least a portion of each tray cell.

9. The method of claim 8 wherein the moving step further comprises moving the one support surface to an elevated position generally perpendicular to the pair of legs associated with the one support surface and moving each of the remaining support surfaces from a position where the support surfaces are generally parallel to the associated legs to an elevated position where the remaining support surfaces are generally perpendicular to the associated legs by moving hinges located at each of the legs associated with the support surfaces.

10. The method of claim 8 wherein the moving step further comprises moving the legs associated with the support surfaces other than the one support surface from a position generally parallel to the bottom wall to a position generally perpendicular to the bottom wall.

11. A unitary paperboard form with perforations arranged for folding the form comprising:

a plurality of adjacent cells each having a generally planar support surface, the support surface having a first pair of opposing edges and a second pair of opposing edges, each support surface further having a pair of legs associated with the support surface, the plurality of adjacent cells including a first cell and a second cell having a hinge connecting one of the legs associated with the first cell to one of the legs associated with the second cell and permitting the first and second cells to pivot about the hinge to a position where the first pair of opposing edges of the first and second cells are facing one another and the second pair of opposing edges of the first and second cells are in line with one another;

each pair of legs includes one leg with a generally planar surface that at least partially overlaps at least a portion of the associated support surface;

the other leg of each pair of legs has a generally planar surface extending in a plane generally parallel to a plane defined by the associated support surface; and wherein each support surface separates each associated leg into a first portion and a second portion, each first portion having a generally planar surface generally extending parallel to the plane defined by the associated support surface and each associated support surface at least partially overlapping each second portion.

12. The paperboard form of claim 11 wherein each cell includes a bottom support surface generally parallel to and abutting the corresponding support surface.

13. An insert for use in elevating food products in a tray, the insert convertible between an erected position for elevating food products in the tray and a collapsed position, the insert comprising:

a plurality of adjacent cells each having an elevated support surface for a food product, a pair of legs associated with each elevated support surface to elevate the support surface and for constraining the food products on the elevated support surface;

one of the product support surfaces having a fold line separating the one of the product support surfaces into a first portion and a second portion, the first and second portions of the product support surface each having a hinge with an adjacent one of their associated legs to permit the first and second portions to be positioned generally parallel to the legs when the insert is in the collapsed position and generally perpendicular to the legs when the insert is in the erected position; and the remainder of the product support surfaces each having a hinge with each of its associated legs to permit the remainder of the elevated support surfaces to be positioned generally parallel to the legs when the insert is in the collapsed position and generally perpendicular to the legs when the insert is in the erected position.

* * * * *